United States Patent [19]

Tanabe et al.

[11] Patent Number: 4,521,284

[45] Date of Patent: Jun. 4, 1985

[54] ELECTROLYTIC METHOD OF PRODUCING A HIGH PURITY ALUMINUM-LITHIUM MOTHER ALLOY

[75] Inventors: Zenichi Tanabe; Katsuhisa Itoh; Yoshiaki Watanabe, all of Nagoya, Japan

[73] Assignee: Sumitomo Light Metal Industries, Ltd., Tokyo, Japan

[21] Appl. No.: 661,554

[22] Filed: Oct. 17, 1984

[30] Foreign Application Priority Data

Nov. 18, 1983 [JP] Japan ..... 58-215989

[51] Int. Cl.[3] ..... C25C 3/36

[52] U.S. Cl. ..... 204/71

[58] Field of Search ..... 204/71

[56] References Cited

U.S. PATENT DOCUMENTS 1,901,407 3/1933 Osborg ..... 204/71

3,822,195 7/1974 Dell et al. ..... 204/71

*Primary Examiner*—Howard S. Williams

*Attorney, Agent, or Firm*—Flynn, Thiel, Boutell & Tanis

[57] ABSTRACT

A method of producing high purity aluminum-lithium mother alloys essentially free from other alkali metals than lithium, which comprises electrolyzing a mixed molten salts consisting of 34 to 64 wt. % of lithium chloride and 66 to 36 wt. % of potassium chloride, and, optionally, 1 to 20 wt. % of sodium chloride based on a combined weight of the aforesaid two components, using solid aluminum as cathodes, and an $\alpha+\beta$ phase aluminum lithium alloy electrode or the alloy coated electrode as a reference electrode, under a current density in the range of 0.005 to 1 A/cm$^2$, whereby producing aluminum-lithium alloys on the cathode. During electrolyzing, the potential difference between the cathode and the reference electrode is continuously measured and differentiated with respect to time and at the point of a sudden change in the differentiated value, electrolyzing is stopped.

4 Claims, 1 Drawing Figure

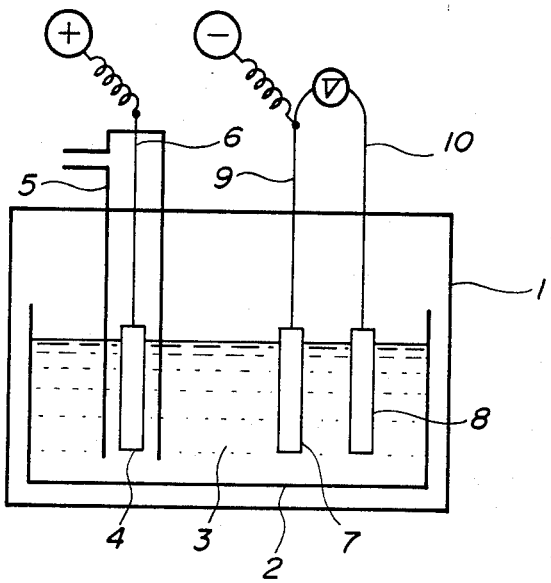
+
−
V
6
10
5
9
1
8
4
3
2
7

ELECTROLYTIC METHOD OF PRODUCING A HIGH PURITY ALUMINUM-LITHIUM MOTHER ALLOY

BACKGROUND OF THE INVENTION

The present invention relates to a method of producing high purity aluminum-lithium mother alloys and more particularly to a method of producing aluminum-lithium mother alloys which substantially do not contain alkali metals such as sodium, potassium, etc., other than lithium.

Aluminum-lithium mother alloys have been heretofore produced by the method involving the following two basic steps.

(1) electrolytic production of lithium metal; and (2) melting and casting

In step (1), metallic lithium is produced by electrolysis of a molten salt mixture consisting of lithium chloride and potassium chloride. In step (2), the metallic lithium produced in the step (1) is added, in an amount needed to produce the aimed mother alloy composition, to aluminum and melted together with obtain cast ingots of the mother alloys.

As the high purity aluminum-lithium mother alloys suitable for use in practical applications, it is requested that they contain lithium in an amount of 10 wt. % or more, and avoid the contamination of sodium exceeding 5 ppm.

At the present time, commercially available electrolytic lithium with a high purity of 99.9% contains approximately 200 ppm sodium and thus it is impossible to produce high purity aluminum-lithium mother alloys using such lithium. Further, in order to produce super-high purity electrolytic lithium with sodium not exceeding 50 ppm, an additional purification process of lithium salts or metallic lithium is necessary. On the other hand, when the purification is carried out by means of molten metal treatment using chlorine gas, serious loss of lithium is unavoidably occurs in significant quantities. Further, current efficiencies in the electrolysis of lithium in the conventional methods are relatively low, as for example 70 to 90% at most.

Further, in the conventional methods of producing aluminum-lithium mother alloys, remelting of the electrolytic lithium with aluminum is indispensable in the foregoing step (2). In addition, in this remelting process, lithium is liable to deteriorate due to its extremely high activity. In order to prevent the unfavorable deterioration, the remelting must be carried out under a controlled atmosphere of inert gas. Further, lithium tends to cause an unfavorable segregation in the course of solidification because of its low melting point and density. Therefore, it is very difficult to produce constantly the mother alloys with stable desired compositions in the conventional methods.

SUMMARY OF THE INVENTION

It is therefore a primary object of the present invention to provide a method of producing a high purity aluminum-lithium mother alloy essentially free from alkali metals such as sodium, potassium, etc., other than lithium wherein the foregoing disadvantages associated with the conventional methods are eliminated.

The present invention resides in a method of producing aluminum-lithium mother alloys with a high purity which comprises electrolyzing a mixed molten salt consisting of 34 to 64 wt. % of lithium chloride and 66 to 36 wt. % of potassium chloride, using one or more solid aluminum cathodes, under a cathodic current density in the range of 0.005 to 1 A/cm$^2$, whereby producing an aluminum-lithium alloy on the cathodes. In the method of the present invention, the mixed molten salt to be electrolyzed may further contain sodium chloride in an amount of 1 to 20 wt. % based on the total amount of the aforesaid two components. In the course of electrolysis, the potential difference between the cathode and an reference electrode is measured, differentiated with respect to time and at a point of a sudden change in the differentiated value, the electrolysis is stopped.

BRIEF DESCRIPTION OF THE DRAWINGS

The single FIGURE is a schematic illustration showing the construction of an electrolytic cell used for carrying out the method of the invention.

DETAILED DESCRIPTION OF THE PREFERRED EMBODIMENTS

The present invention will now be described in detail hereinafter.

The inventors of the present invention have conducted various extensive studies and attempts and, as a result, arrived at the finding that when the electrolysis of a mixed molten salt of LiCl and KCl is carried out under a cathodic current density of 0.005 to 1 A/cm$^2$ using one or more cathodes made of solid aluminum, a high purity aluminum-lithium alloy can be successfully formed on the aluminum cathodes without floating lithium on the surface of the electrolytic bath and without depositing sodium. The current efficiency of the electrolysis of the present invention reached almost 100%. As to the reasons why such high purity aluminum-lithium alloys are obtained, it is considered that lithium deposited electrolytically on the cathodes diffuses into the solid aluminum and form a lithium-aluminum compound. The resulting lithium-aluminum compound effectively acts as depolarizer, thereby reducing the decomposition potential of LiCl. In contrast, sodium does not have such depolarizing effect and, thus, the decomposition potential of NaCl is unchanged. Consequently, only lithium is deposited without causing an unfavorable contamination of sodium into the cathode material.

The present invention is based on the finding and observation set forth above and provided a method making it possible to produce aluminum-lithium mother alloys with a high purity in a high yield, only by electrolysis process of metallic lithium.

In the present invention, an electrolytic bath consists of 34 to 64 wt. % of LiCl and 66 to 36 wt. % of KCl and the aimed objects can be readily realized within the specified ranges of the both components. In addition to the foregoing two components, NaCl may be added optionally in an amount of 1 to 20 wt. % with respect to the combined weight of the two components. The addition of NaCl depresses the melting point of a mixed salt of LiCl-KCl and lowers the electrical resistance of the electrolytic bath. The effects of NaCl are advantageous in that the electric power consumed in the electrolysis is significantly saved. As long as the NaCl content is controlled in the range specified above, no deposition of sodium takes place, even if its content is increased. On the contrary, an addition of NaCl exceeding 20 wt. %, increases an electrical resistance of the bath, whereas a low NaCl content of less than 1 wt. % does not reduce the melting point of the bath to a desired level.

In the present invention, the cathodic current density must be adjusted in the range of 0.005 to 1 A/cm$^2$. When the cathodic current density is higher than 1 A/cm$^2$, deposited lithium tends to float on the bath surface surrounding aluminum cathodes rather than to diffuse into the aluminum cathodes, thereby lowering an alloying yield of lithium into the Al cathodes. While an insufficient current density of less than 0.005 A/cm$^2$ decreases both the amounts of deposited lithium and lithium-aluminum product, and the productivity for the purposed product is lowered.

Further, while the molten salt made up of the aforementioned constituents is electrolyzed using one or more solid aluminum cathodes, the potential difference between the cathode and an aluminum-lithium alloy electrode as the reference electrode is continuously measured, the aluminum-lithium alloy being in the $(\alpha+\beta)$ phase at the electrolysis temperature, and the measured potential difference is differentiated with respect to time. Electrolysis is proceeded till the differentiated value changes suddenly and at this point of sudden change, the electrolysis is stopped. Aluminum-lithium alloys produced in this manner are constantly uniform in their compositions. On the other hand, it was found that where the electrolysis is further proceeded after the end point, metallic lithium deposited on the cathode floats on the surface of the electrolytic bath, thereby resulting in a significant reduction in alloying yield of lithium. Thus, in practicing the invention, it is preferred that electrolysis operation be proceeded while continuously measuring the potential of the cathode using, as the reference electrode, an aluminum-lithium alloy having the composition developing the foregoing phase at the operation temperature or appropriate articles having a coating of the aluminum-lithium alloy thereon, and stopped at the point of the sudden change in the potential of the cathode. When the reference electrode materials are made of aluminum-lithium alloys with the $\alpha$ single phase, the equilibrium potentials will widely vary depending on lithium contents of the used alloys and, thus, such electrodes lack stability as the reference electrode. On the other hand, in the case of the $\beta$ single phase aluminum-lithium alloys, the alloy is very active and lack stability in the electrolytic bath. Thus, when such single phase aluminum-lithium alloys are employed as a reference electrode material, it is very difficult to obtain stable equilibrium potentials. This property makes the single phase aluminum-lithium alloys inadequate for the use as the reference electrode materials. However, in the case of using aluminum-lithium alloys with the $\alpha+\beta$ phase, highly stabilized equlibrium potentials can be realized.

The single FIGURE is a schematic illustration showing, as an example, an electrolytic cell employed for embodying the present invention. Reference numerals 1 and 2 are an outer casing of the cell and a container made of sintered alumina or the like, respectively. LiCl-KCl fused salt 3 is contained in the container 2 and an anode 4, made of graphite, is suspended from above by a lead rod 6 within a tube 5, the tube 5 being disposed for collecting and exhausting generated chlorine gas. A solid aluminum cathode 7 and an alumimum-lithium alloy reference electrode 8 are suspended from above by lead rods 9 and 10, respectively. V is a potentiometer. Also, a plurality of anodes and cathodes can be employed in the cell.

In accordance to the present invention, high purity aluminum-lithium mother alloys were produced in the following Examples 1 to 6, using the electrolytic cell previously described. Production conditions and results of Examples 1 to 5 are indicated in Table below.

TABLE

| Example No. | Composition of Bath | Cathode Material | Current Density |
|---|---|---|---|
| 1 | 45 wt. % LiCl −55 wt. % KCl | 8 mm Diameter 99.99 wt. % Al, Na < 5 ppm | 0.1 A/cm$^2$ |
| 2 | 49 wt. % LiCl −51 wt. % KCl | 8 mm Diameter 99.99 wt. % Al, Na < 5 ppm | 0.4 A/cm$^2$ |
| 3 | 43 wt. % LiCl −49 wt. % KCl −8 wt. % NaCl | 8 mm Diameter 99.99 wt. % Al, Na < 5 ppm | 0.11 A/cm$^2$ |
| 4 | 43 wt. % LiCl −49 wt. % KCl −8 wt. % NaCl | 8 mm Diameter 99.99 wt. % Al, Na < 5 ppm | 0.4 A/cm$^2$ |
| 5 | 43 wt. % LiCl −49 wt. % KCl −8 wt. % NaCl | 1.6 mm Diameter 99.99 wt. % Al, Na < 5 ppm | 0.8 A/cm$^2$ |

| Example No. | Composition of Mother Alloy | Na Content in Mother Alloy | Current Efficiency | Na Content in bath |
|---|---|---|---|---|
| 1 | 10.8 wt. % Li | ≦5 ppm | >99% | 500 ppm |
| 2 | 18.2 wt. % Li | ≦5 ppm | >99% | 500 ppm |
| 3 | 18.2 wt. % Li | ≦5 ppm | >99% | 500 ppm |
| 4 | 12.5 wt. % Li | ≦5 ppm | >99% | 500 ppm |
| 5 | 18.8 wt. % Li | ≦5 ppm | >99% | 500 ppm |

EXAMPLE 6

The electrolysis of an electrolytic bath made up of 45 wt. % LiCl-55 wt. % KCl was commenced at a current density of 0.1 A/cm$^2$, using a reference electrode of 13 wt. % lithium-aluminum alloy and a cathode of 99.99 wt. % aluminum(8 mm diameter, sodium <5 ppm). In the course of the electrolysis, the potential difference between the cathode and the reference electrode was continuously measured and differentiated with respect to time. The pontential difference gradually lowered with time while its differential value was approximately constant. However, after 263 minutes, a sudden change in differentiated value was detected and the electrolysis was stopped.

The mother alloy thus obtained consisted of 18.6 wt. % lithium-aluminum, a contamination of sodium was not more than 5 ppm, and the current efficiency was not less than 99%. On the other hand, the bath after the electrolysis was found to contain 610 ppm of sodium ion derived from impurities.

As previously stated, in accordance to the present invention, it is possible to directly produce high purity aluminum-lithium mother alloys essentially free from any other alkali metal, such as sodium or potassium, than lithium only by electrolysis process and the alloying yield of Li reached almost 100% by virture of the production process according to the present invention. Further, according to the present invention, even if NaCl is contained in an electrolytic bath, the resulting mother alloys do not contain sodium. Therefore, NaCl can be added to a LiCl-KCl mixture, whereby providing significant effects in decreasing the melting point of the electrolytic bath, increasing the conductivity of the electrolytic bath and saving the electric power consumed in the electrolysis.

In addition to these advantages, the present invention provides the advantage set forth below.

(1) Electrolysis can be carried out in safety, because an active metallic lithium is not handled.

(2) It is easy to control lithium contents in mother alloys.

(3) The cost of installation is significantly reduced, because of its extremely simplified process.

What is claimed is:

1. A method of producing a high purity aluminum-lithium mother alloy comprising electrolyzing a mixed molten salt consisting essentially of 34 to 64 wt. % of lithium chloride and 66 to 36 wt. % of potassium chloride under a cathodic current density in the range of 0.005 to 1 $A/cm^2$, using one or more solid aluminum cathodes, and thereby depositing aluminum-lithium alloys essentially free from alkali metals other than lithium on said cathodes.

2. A method as claimed in claim 1 in which said mixed molten salt further contain sodium chloride in an amount of 1 to 20 wt. % based on the total weight of said lithium chloride and said potassium chloride.

3. A method as claimed in claim 1 in which an electrode made of aluminum-lithium alloy or an electrode having a coating of said aluminum-lithium alloy on the surface thereof is employed as a reference electrode, said aluminum-lithium alloy used in said reference electrode being in the $(\alpha+\beta)$ phase at an electrolysis temparature, and said electrolysis is performed while measuring continuously the potential difference between said cathode and said reference electrode and then differentiating said potential difference with respect to time, and said electrolysis is stopped at the point at which differentiated value is suddenly changed.

4. A method as claimed in claim 2 in which an electrode made of aluminum-lithium alloy or an electrode having a coating of said aluminum-lithium alloy on the surface thereof is empoyed as a reference electrode, said aluminum-lithium alloy used in said reference electrode being in the $(\alpha+\beta)$ phase at an electrolysis temperature, and said electrolysis is performed while measuring continuously the potential difference between said cathode and said reference electrode and then differentiating said potential difference with respect to time, and said electrolysis is stopped at the point at which differentiated value is suddenly changed.

* * * * *